US005688124A

United States Patent [19]

Salzeder

[11] Patent Number: 5,688,124

[45] Date of Patent: Nov. 18, 1997

[54] METHOD FOR SIMULATING WEAPONS FIRE, AND HIGH-ANGLE TRAJECTORY WEAPONS FIRE SIMULATOR

[75] Inventor: Rudolf Salzeder, Piding, Germany

[73] Assignee: Buck Werke GmbH & Co., Bad Ueberkingen, Germany

[21] Appl. No.: 393,488

[22] Filed: Feb. 24, 1995

[30] Foreign Application Priority Data

Mar. 4, 1994 [DE] Germany ..... 44 07 294.5

[51] Int. Cl.[6] ..... F41A 33/00

[52] U.S. Cl. ..... 434/11

[58] Field of Search ..... 434/11, 12, 16

[56] References Cited

U.S. PATENT DOCUMENTS

| | | | |
|---|---|---|---|
| 4,226,292 | 10/1980 | Monte et al. | 434/11 X |
| 4,443,014 | 4/1984 | Kovit et al. | 434/14 X |
| 4,744,761 | 5/1988 | Doerfel et al. | 434/16 X |
| 5,269,214 | 12/1993 | Badura et al. . | |
| 5,382,958 | 1/1995 | FitzGerald | 434/16 X |

FOREIGN PATENT DOCUMENTS

| | | |
|---|---|---|
| OS 37 05 700 | 9/1988 | Germany . |
| OS 40 14 195 | 11/1991 | Germany . |
| 2 176 271 | 12/1986 | United Kingdom . |

OTHER PUBLICATIONS

"Gefecthsdarstellung für Kampfpanzer," Volze, Wehrtechnik, Aug., 1977, pp. 46–49.

*Primary Examiner*—Jeffrey A. Smith

*Attorney, Agent, or Firm*—Hill, Steadman & Simpson

[57] ABSTRACT

In a method for simulating high-angle trajectory weapons fire in a combat exercise field, whereby the effect of hostile fire is realistically simulated for persons situated in a selectable target region and/or for a referee in a central referee location, the combat exercise field is divided into a number of grid squares of such a size that a neighboring grid square can be reached in at most one minute with a combat vehicle proceeding from a readiness location defined by the respective mid-point of the grid square. A mobile high-angle trajectory weapons fire simulator is respectively positioned in a number of, but not in all readiness locations, the simulator including a combat vehicle having a multiple firing unit for simulation ammunition arranged thereon and being in communication with the central referee location such that the position of the respective high-angle trajectory weapons fire simulator can be essentially recognized at any time. The position of the high-angle trajectory weapons fire simulator can be selected proceeding from the central reference location as can a selective firing of simulation ammunition with the multiple firing unit. Given a selectable target region that can be defined from the central referee location and given a defined, selectable high-angle trajectory weapons fire situation, at least one high-angle trajectory weapons fire simulator is brought into a firing position from the readiness location or locations lying most favorably relative to the selected target region. Subsequently, the exercise ammunition is fired proceeding from a command from the central referee location. A high-angle trajectory weapons fire simulator and simulation ammunition therefor are also disclosed.

32 Claims, 5 Drawing Sheets

METHOD FOR SIMULATING WEAPONS FIRE, AND HIGH-ANGLE TRAJECTORY WEAPONS FIRE SIMULATOR

BACKGROUND OF THE INVENTION

1. Field of the Invention

The invention is directed to a method and apparatus for simulating weapons fire in a combat exercise field, whereby hostile fire is realistically simulated for persons located in a selectable target area and/or a referee in a central referee location under combat conditions. The invention is also directed to simulation ammunition for use in the apparatus.

2. Description of the Prior Art

It is already possible in modern combat exercise centers to realistically represent weapons fire with a flat trajectory one. The action of the round is simulated, for example, by laser radiation, and the "hits" are then realistically acquired by appropriate sensors in the target area and, for example, can be communicated at a central referee location.

Heretofore, however, it has not been possible to realistically represent high-angle trajectory weapons fire in such combat exercise centers, since the use of a direct, optical ballistic simulation is not an available solution.

SUMMARY OF THE INVENTION

It is an object of the present invention to provide a method of simulating weapons fires with which the fire trajectory of high-angle firearms can be represented as realistically as possible in a combat exercise center (CEC). Further, it is an object of the present invention to provide a high-angle trajectory weapons fire simulation device as well as a simulation ammunition for employment therein.

This object is inventively achieved in a method wherein the combat exercise field is divided into a plurality of grid squares for high-angle trajectory weapons fire simulation, the grids having such a size that a combat vehicle can, staffing from any grid square, reach a neighboring grid square in at most one minute proceeding from a readiness location defined by the middle of the starting grid square. A mobile high-angle trajectory weapons fire simulation device is positioned in a number of, but not in all, readiness locations. This device is formed by a combat vehicle having a multiple firing means for simulation ammunition arranged thereon which is in communication with a central referee location such that the position of the high-angle trajectory weapons fire simulation device can be essentially recognized at any time. The position of the high-angle trajectory weapons fire simulation device can be selectively controlled (ordered) from the central location and a selective firing of simulation ammunition with the multiple firing means also can be controlled (ordered) from the control location. Given a selectable target area defined by the central referee location and a predetermined, selectable high-angle trajectory weapons fire situation, at least one high-angle fire simulation device is brought into firing position proceeding from the readiness position or positions lying most favorably relative to the selected target area. Subsequently, the training ammunition is fired under control (orders) from the central referee location.

The grid squares may have an edge length of approximately 1 km.

Each high-angle trajectory weapons fire simulation devices can be equipped with a means for automatic, continuous identification and communication of its position.

The method of the invention can also be used with high-angle trajectory weapons fire simulation devices respectively having a global positioning system (GPS) and/or gyroscope means available to them.

The high-angle trajectory weapons fire simulation device for employment in the method of the invention, has a multiple firing means for simulation ammunition, directable at least around a horizontal axis, arranged on a combat vehicle. Communication means for establishing a communication link between the high-angle trajectory weapons fire simulation means and the central referee location are provided.

The firing means can include a main firing platform for simulation ammunition for HE/bomlets, flares and/or mines, mortars and/or artillery or the like.

Preferably the simulation ammunition of the main firing platform has a standard firing range of approximately 300 m.

It is preferred that the main firing platform have a plurality of magazine plates, each having a plurality of firing barrels for simulation ammunition shells.

The simulation ammunition of the main firing platform may have a caliber of 26 mm.

The main firing platform may have three magazine plates having a total of 164 firing barrels for simulation ammunition shells.

Ammunition shells are provided within each of the magazine plates, these shells, respectively separately identified with colors, having powder charges and/or delay elements that deviate from one another in groups.

The magazine plates are slid onto the main firing platform.

The individual magazine plates can be arranged on the main firing platform with firing directions that diverge vertically and/or horizontally.

Alternatively the firing directions are selectable for the individual magazine plates.

The firing directions for the magazine plates are selectable proceeding from the central referee location.

The firing means, may also include a subsidiary firing platform for smoke screen and/or ABC ammunition.

In a preferred exemplary embodiment of the invention, the main firing platform and the subsidiary firing platform are arranged on an essentially horizontal turntable of the mobile vehicle, having firing directions offset by 180° and which are directed radially obliquely upward and outward.

Preferably the simulation ammunition of the subsidiary firing platform has a caliber of 81 mm.

It is also inventively proposed that a means for automatic, continuous identification and transmission of position is arranged at the vehicle.

The type of simulation ammunition can be selected proceeding from the central location, in terms of its nature and in view of the location and point in time of firing.

The vehicle can be manned.

The simulation ammunition of the invention is characterized in that the individual ammunition shells (the term "shell" being used generically to designate the entire unit, not just the casing) each comprise a squib, a propulsive charge for a particular firing range, an active charge and a delay element.

The invention is based on the surprising perception that a realistic representation of high-angle trajectory weapons fire can be successfully realized in a combat exercise center using a launcher means as disclosed, for example, by German PS 37 05 700, German OS 40 14 195 or German OS 41 25 356 for other purposes, an optimized selection of readiness locations on a combat training field divided into grid squares is equipped with high-angle trajectory weapons fire simulation devices of the invention, which are moved and engaged according to the criterion of the corresponding commands, possibly automatically as well, proceeding from the central referee location.

The invention makes it possible to represent immediate firing support (UF), particularly in view of the fact that two reinforced combat battalions usually participate in an exercise in the CEC.

The fire of mortar (Mrs) and or artillery (Art) can be simulated at any desired location of the combat exercise field. For Mrs fire, individual firings, semi-automatic and automatic firing can be simulated, as can procedures for battlefield illumination, whereas, given Art employment, individual firing, automatic firing and/or battery firing as well as battalion fire groupings can be simulated, as can mine-laying rocket artillery.

The time sequence of firing instructions and firing commands up to termination of target correspond to the real-time employment of Art and Mrs. The spatial target coverage and the utilization of ammunition likewise correspond to real-time employment. The firing simulation is such that both the troops affected by the firing as well as neighboring troops can dearly identify the fire, as can the central referee location. The employment of the apparatus and the simulation method of the invention do not impair or impede the battle sequence. The entire firing simulation can be controlled and monitored with little outlay proceeding from the central referee location. The safety of the operating personnel as well as of the exercising troops is not impaired in any way whatsoever by the high-angle firing simulation, neither when firing the simulation ammunition nor at the target.

DESCRIPTION OF THE PREFERRED EMBODIMENTS

Figure 1:
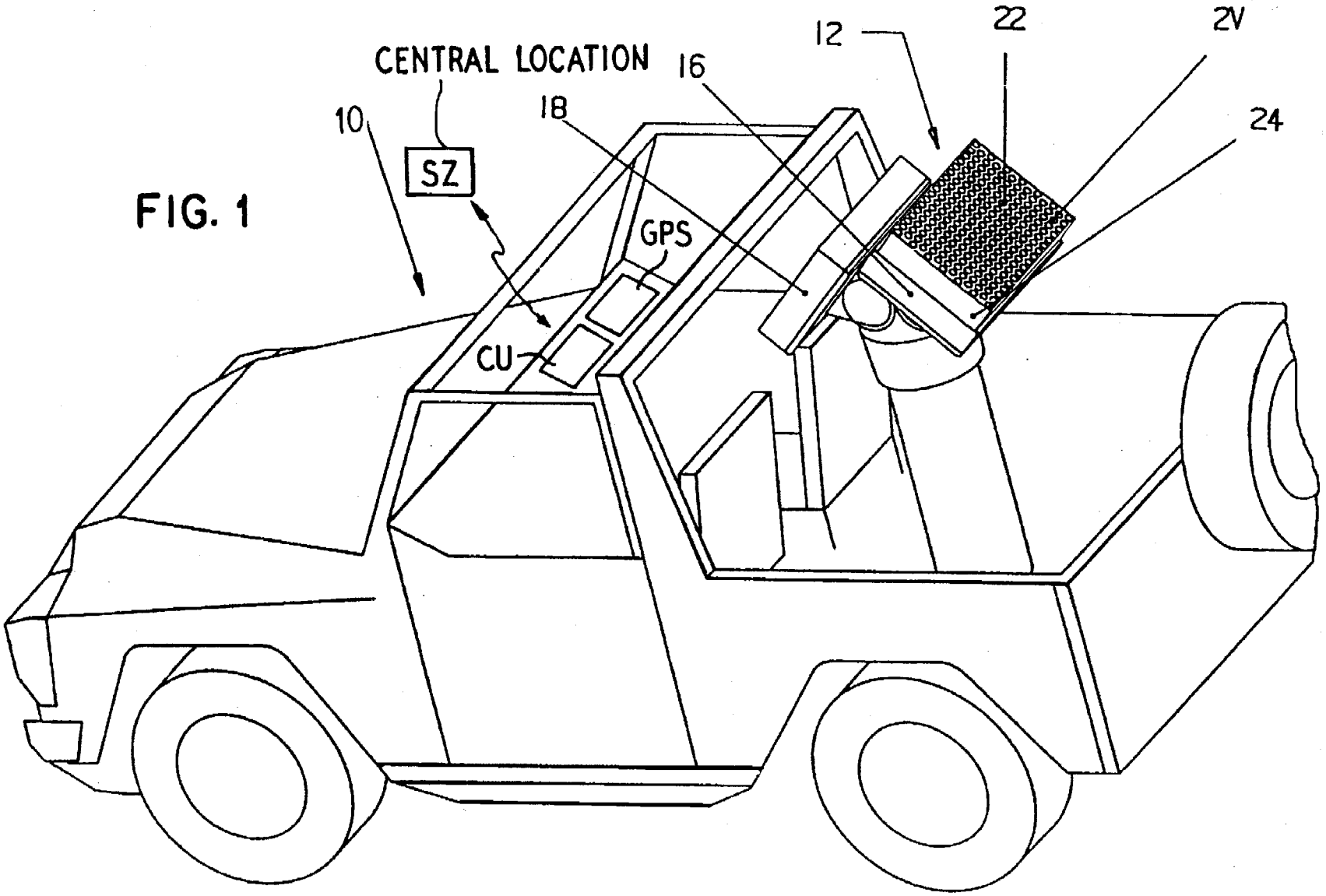
FIG. 1 shows an exemplary embodiment of a high-angle trajectory weapons fire simulator employable in the method of the invention, in a perspective view.
Figure 2:
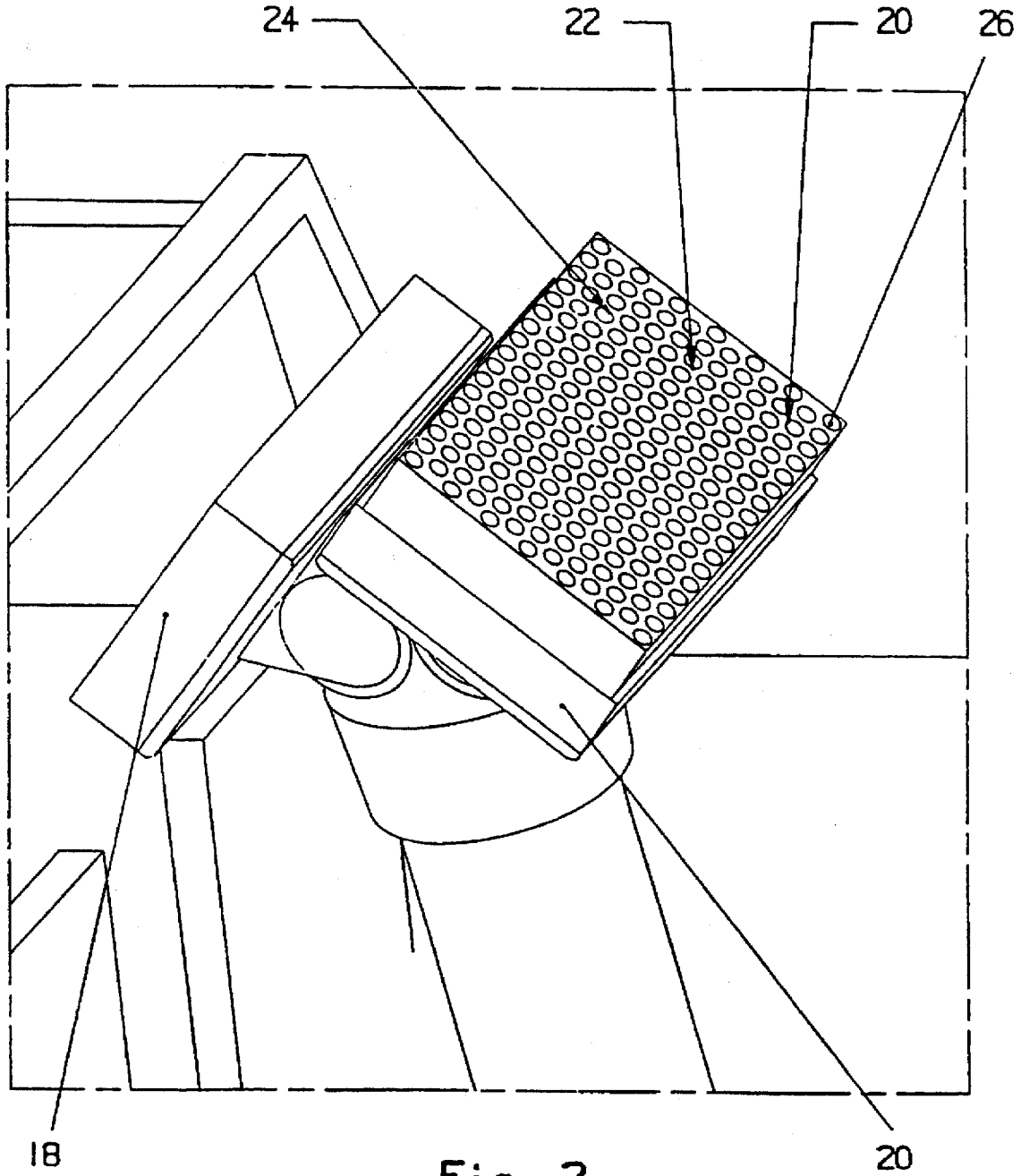
FIG. 2 shows a main firing platform of the high-angle trajectory weapons fire simulator of FIG. 1, in a perspective view.

As FIG. 1 shows, an exemplary embodiment of a high-angle trajectory weapons fire simulator employable in an exemplary embodiment of the method of the invention includes a combat vehicle 10 that carries a firing unit 12. On a turntable 14 rotatable through at least 180° around a vertical axis, the firing unit 12 has a main firing platform 16 and a subsidiary firing platform 18 arranged offset by 180° relative to one another around a vertical axis. As FIG. 2 shows, the main firing platform 16 is equipped with three magazine plates 20, 22 and 24 having a total of 164 ammunition shells of a 26 mm caliber simulation ammunition. Within the individual magazine plates 20, 22 and 24, the individual ammunition shells—which have a different color for each magazine plate in order to enable an easy allocation under exercise conditions—have respectively different active charges and delay elements.

The subsidiary firing platform 18 is equipped with 81 caliber smoke screen ammunition. The simulation ammunition allocated to the magazine plates 20, 22 and 24 end composed of individual ammunition shells 26 has a maximum range of approximately 300 m, whereas the smoke screen ammunition of the subsidiary firing platform 18 has a range of approximately 30 m, as is typical for smoke screen ammunition.

Figure 3:
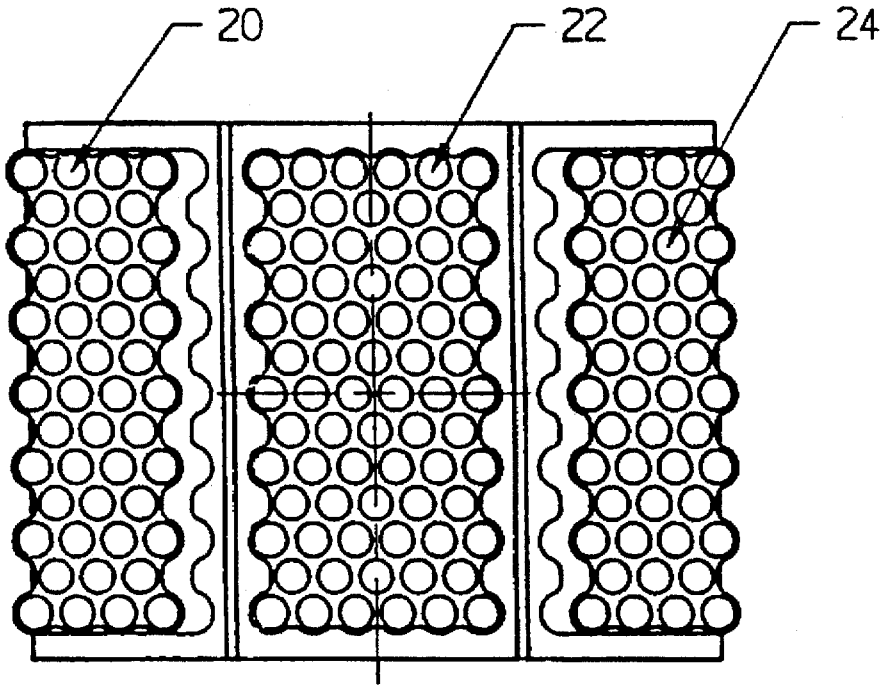
FIG. 3 shows the main firing platform of the high-angle trajectory weapons fire simulator of FIG. 1 and FIG. 2, in a plan view.
Figure 4:
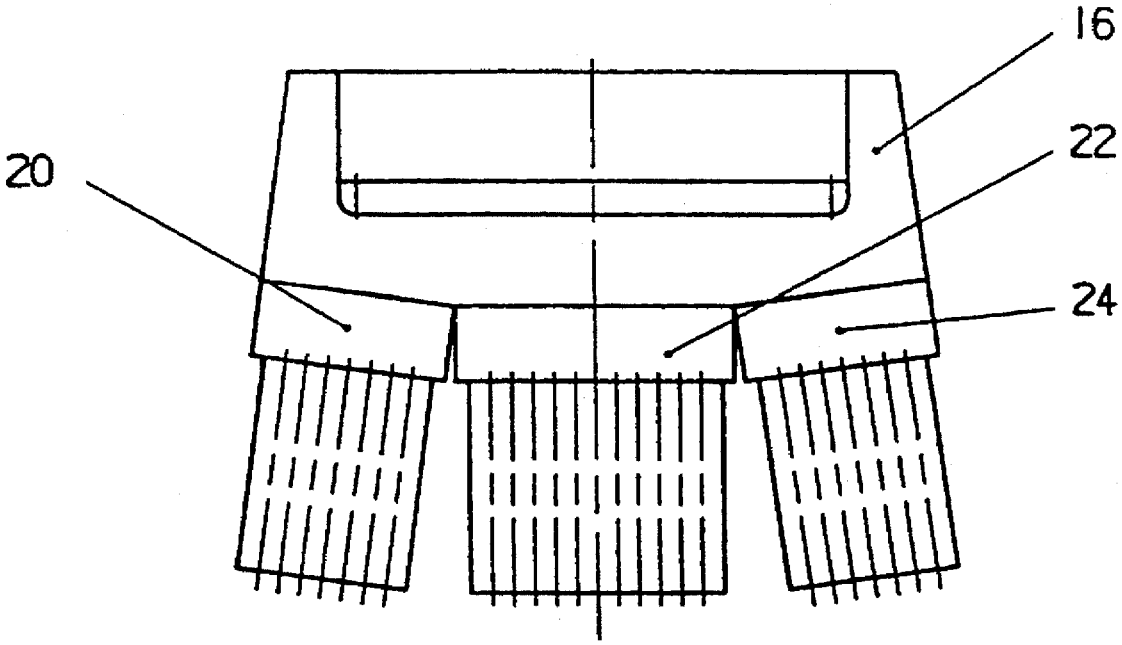
FIG. 4 shows the main firing platform of the high-angle trajectory weapons fire simulator of FIGS. 1–3 in a view obliquely from above perpendicular to the direction of the firing barrel.

FIG. 3 shows that the individual magazine plates 20, 22 and 24 together with the respective ammunition shells 26 can be arranged such that each of the magazine plates in FIG. 3 has three groups, viewed from top to bottom, of simulation ammunition shells 26 having different ranges that are identified by different colors. As shown in FIG. 4, the lateral magazine plates 20 and 24 diverge laterally by 8° relative to the middle magazine plate 22.

The vehicle 10, for example, can be a of a combat truck having an allowable gross weight of 0.9 tons. The combat vehicle 10 is equipped with a satellite position identification system (GPS) and gyroscope and is continuously connected to a schematically indicated central referee location SZ via voice link/data link established by a communication unit CU in the illustrated exemplary embodiment. The energy supply for the overall high-angle trajectory weapons fire simulator, composed of the vehicle 10 and the firing unit 12, is autonomous (self-contained). Thus, an energy supply system (generator) is provided in the vehicle 10 which runs off the motor. The range of lateral directivity of the firing unit 12 preferably amounts to 180° but, of course, can also be fashioned larger or smaller. An elevation directivity of the main firing platform 16 and the subsidiary firing platform 18 is not required but, of course, can be provided as warranted.

Fundamentally, the main firing platform 16 serves the purpose of firing all types of ammunition desired for the firing simulation, with the exception of smoke screen and/or ABC ammunition. Infrared smoke screen ammunition, as disclosed by German OS 41 25 356 serves, for example, as ammunition for the latter, for which the subsidiary firing platform 18 is provided. Launcher devices that correspond in terms of structure and functioning, including simulation and smoke screen ammunition corresponding to the self-firing launcher means of German OS 41 25 356, moreover, can be advantageously utilized for the overall firing unit 12, this publication being referenced for further explanation.

The high-angle trajectory weapons fire simulator includes a simple on-board computer and a display screen for expedient operator information. A person is required for moving and operating the vehicle 10 and/or the firing unit 12.

HE/bomlet, flare, mine and/or ABC ammunition can be provided as types of ammunition of the simulation ammunition that is fired from the main firing platform 16 of the firing unit 12. In addition to containing the squib, the simulation ammunition of the main firing platform 16 contains a propulsive charge for the corresponding firing range, an active charge and a delay element that assures a detonation in the air of the simulation body at a safe height above ground. The active charge HE/bomlet generates a detonation report and a light flash, for example in the manner of a cartridge which produces a detination report. The active charge for mines likewise generates a detonation report, light flash and cloud of smoke; the light flash and cloud of smoke thereby having a specific color for recognizing this type of ammunition. The active illumination charge, corresponds to exercise flare ammunition that is already known which can be fired manually or from a flare gun. The flare can thereby be ejected to a height matched to its burning duration and parachute descent rate and can thus effect a true illumination of the combat field.

Due to the angular arrangement of the magazine plates 20, 22 and 24 according to the exemplary embodiment of FIGS. 3 and 4, the necessary breadth of fire distribution is assured at the target. For mass fire functions, a modification of the lateral direction may be additionally expedient. The firing distribution in range is achieved in that the respective ammunition shells differ on the basis of three different propulsive charges and delay elements within the respective individual magazine plates 20, 22 and 24. The respective ammunition shells are identified with colors and, for safety reasons, can be loaded only into the firing barrels provided therefor. As a result, the elevation directively and the necessity of utilizing double or wide angle squibs is avoided, a substantial cost-saving resulting therefrom.

The standard firing angle for the ammunition shells 26 can be selected solely in view of safety requirements and is then invariable. The arming safe distance is thereby limited to only a few meters.

The firing direction can preferably be forwardly directed, i.e. over the cab of the vehicle 10, an operator can drive the high-angle trajectory weapons fire simulator in the general firing direction while simultaneously observing of the combat field as set forth below.

Separate magazines can be provided for the ammunition types of HE/bomlet, mine and flare. Fired simulation ammunition can be unproblematically and safely reloaded as needed by the operator of the high-angle trajectory weapons fire simulator in the firing position or at a readiness location, as set forth in greater detail below.

In the illustrated exemplary embodiment of FIGS. 1–4, four magazines each having four rounds of smoke screen/ABC simulation ammunifior can be slid onto the subsidiary firing platform 18 for the smoke screen or for the ABC ammunition as warranted. Given lateral directivity through 180° of the general firing direction toward the back, this ammunition can be selectively fired with standard elevation for, for example, a 30 m range.

Figure 5:
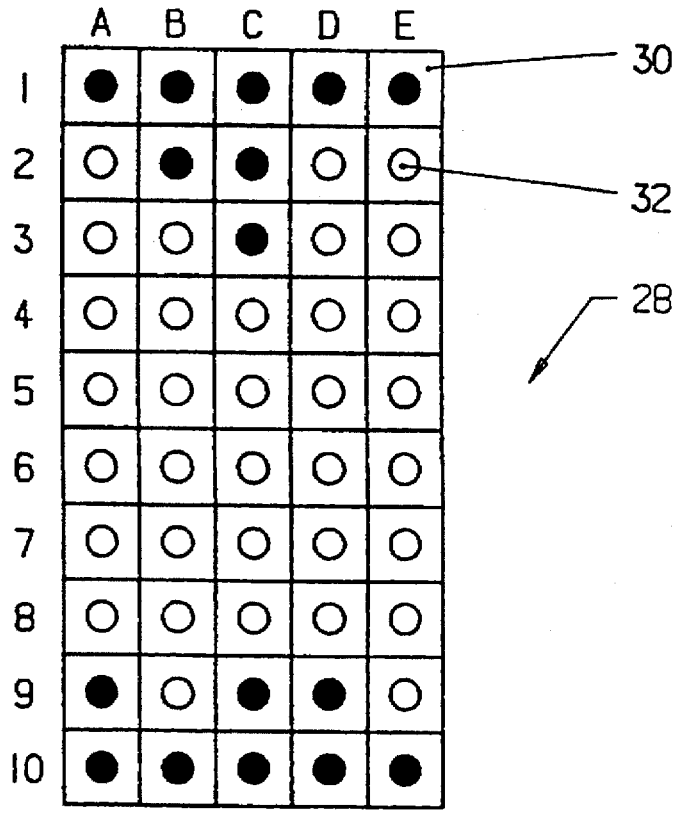
FIG. 5 shows a combat exercise field divided into grid squares according to the method of the invention, in a plan view.

For employing the high-angle trajectory weapons fire simulator according to FIGS. 1–4 in an exemplary embodiment of the method of the invention as shown in FIG. 5, a combat exercise field 28 is divided into a series of grid squares A1, A2, etc., whereby the individual grid squares 30 each have an edge length of 1 kilometer. A readiness location 32 is provided in the middle of each of the grid squares 30. The readiness locations 32 shown with solid circles in FIG. 5 are each equipped with a high-angle trajectory weapons fire simulator according to FIGS. 1–4, whereas the empty circles represent theoretical readiness locations that, however, are not equipped with high-angle trajectory weapons fire simulators in the initial condition shown in FIG. 5.

Figure 6:
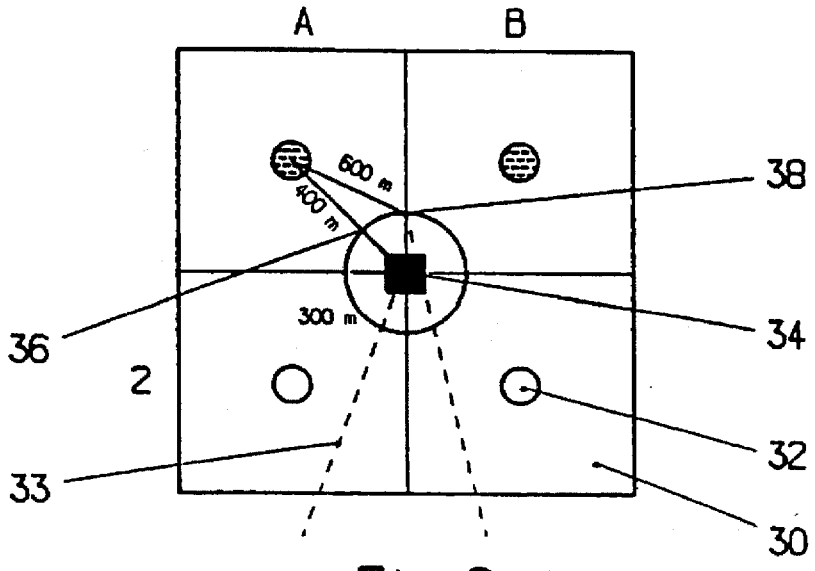
FIG. 6 shows an excerpt from the combat exercise field of FIG. 5, enlarged and in plan view under high-angle trajectory weapons fire simulation conditions.

FIG. 6 shows a possibility for estimating the time needed for a firing simulation, whereby a distances 400 meters results for the travel distance of a vehicle 10 of a high-angle trajectory weapons fire simulator from an equipped readiness location 32 in the grid square A1, given an unfavorable position 33 of a target 34, in order to proceed into a most-favorable firing position 36, whereas the travel distance for a worst-case firing position 38 would amount to 600 meters. The following calculated time example assumes a cruising speed of the vehicle 10 of 15 km/h from the readiness location 32 in the middle of grid square A1: The input of the firing command into the computer of the central referee location requires 10 seconds. The communication of the command to the high-angle trajectory weapons fire simulator requires 1 second. Getting to the worst-case firing position 38 requires 144 seconds (travel distance 600 meters). Ten seconds are required for producing firing readiness, aiming and firing and another 8 seconds are necessary for the flight time of the simulation ammunition body 26. An overall time of 173 seconds arises therefrom. In the worst case, i.e. the greatest possible range of the target 34 from the readiness point 32 (in grid square A1 in the illustrated exemplary embodiment) and a target axis of 150° relative to the direction from the readiness location to the target, approximately 3 minutes thus elapse from the firing command of an advance observer until the detonation of the ammunition body 26 in the target region.

When the target axis plays no part, the travel distance of the vehicle 10 from the readiness location 32 in the grid square A1 to the firing position 38 in the above-described case is shortened to 400 m and, thus, the traveling time is shortened to 96 seconds. The fire mission then lasts approximately 2 minutes.

In all other cases, the travel distance to the firing position is shorter, as a result of which the time for firing missions always lies below 2 minutes. This also corresponds to the times of artillery or mortar engagement under real-time combat conditions.

Only in the case of smoke screen laying, whereby the vehicle 10 would have to travel into the target region, would a travel distance from the readiness point to the firing location of 700 occur as the worst case, thus resulting in a mission time of approximately 3.5 minutes.

As FIGS. 7–10 show as examples, different target coverages or hit patterns can be achieved with a high-angle trajectory weapons fire simulator given the method of the invention.

Figure 7:
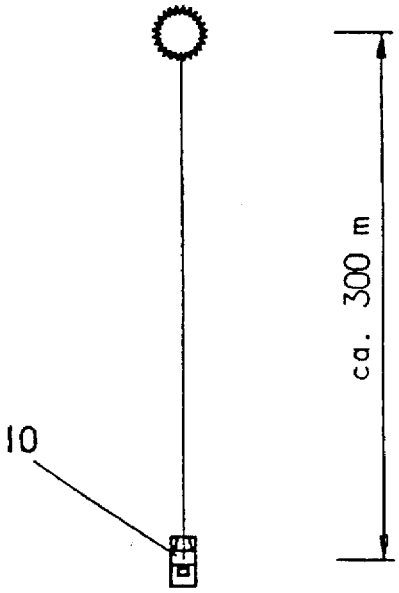
FIG. 7 shows a first exemplary embodiment of a high-angle trajectory weapons fire simulation ensuing according to the method of the invention, in a schematic plan view.
Figure 8:
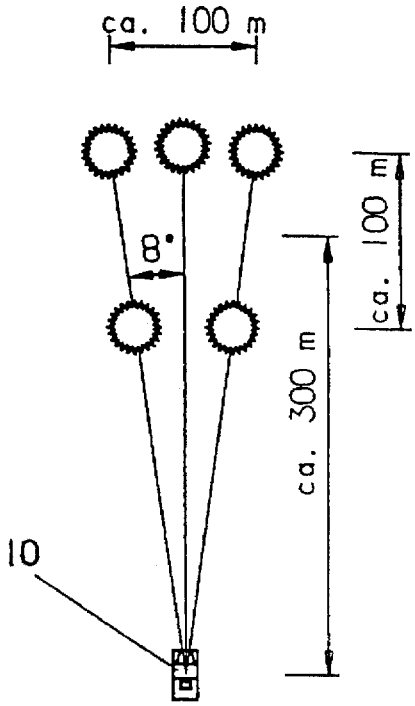
FIG. 8 shows a second exemplary embodiment of a high-angle trajectory weapons fire simulation ensuing according to the method of the invention in an illustration corresponding to FIG. 7.
Figure 9:
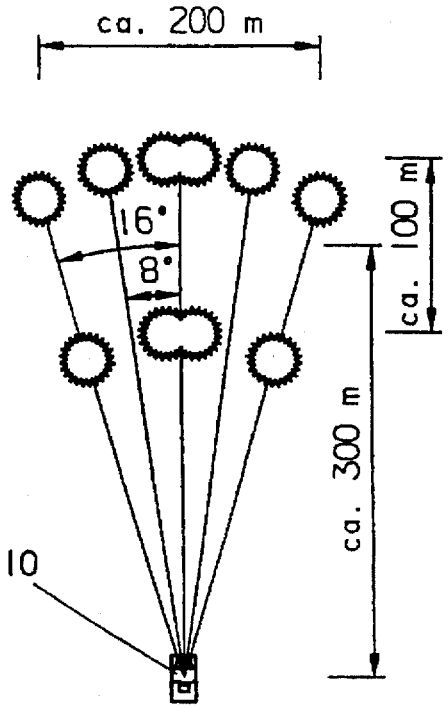
FIG. 9 shows a third exemplary embodiment of a high-angle trajectory weapons fire simulation ensuing according to the method of the invention in an illustration corresponding to FIG. 7.
Figure 10:
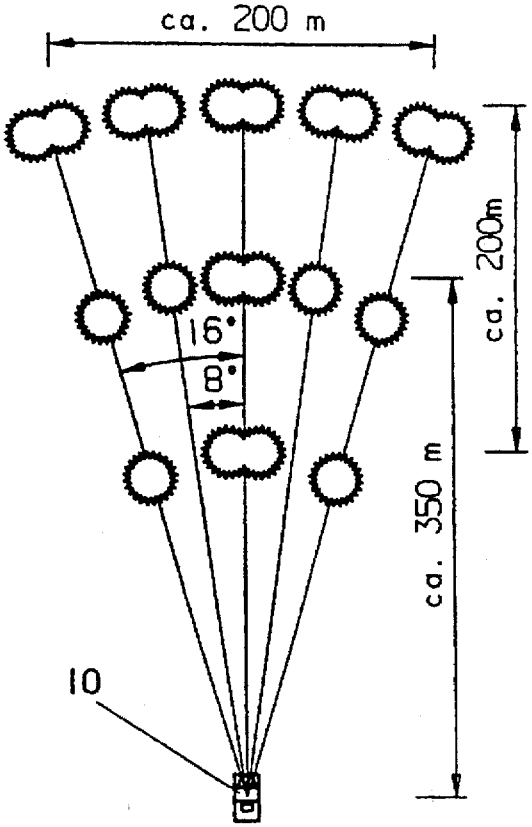
FIG. 10 shows a fourth exemplary embodiment of a high-angle trajectory weapons fire simulation ensuing according to the method of the invention in an illustration corresponding to FIG. 7.

The exemplary embodiment of FIG. 7 illustrates individual fire (artillery or mortar, i.e. Art/Mrs); the exemplary embodiment according to FIG. 8 illustrates automatic fire Art/Mrs (5 rounds); the exemplary embodiment of FIG. 9 illustrates battery fire Art/Mrs (10 rounds) and the exemplary embodiment of FIG. 10 illustrates battalion fire Art (18 rounds).

Of course, other hit patterns can be realized at the discretion of the central referee location.

The high-angle trajectory weapons fire simulator of the invention can thus represent individual firing, semi-automatic fire, automatic fire, battery fire and battalion mass fire functions as well as laid mine fields and the various types of bafflefield illumination. The target coverage corresponds to the real area expanse of Art and Mrs fire. The magazine equipping is so all-encompassing that a realistic quantity of ammunition can be employed.

The smoke screen/ABC ammunition is fired in the target zone to a distance of approximately 30 meters from the vehicle 10 with the subsidiary firing platform 18. The high-angle trajectory weapons fire simulator can, without reloading, lay an infrared-effective smoke screen wall of approximately 40 meters for approximately 3 minutes, or of approximately 80 meters for approximately 1.5 minutes, or of approximately 160 meters for approximately 0.75 minutes. Given corresponding wind and weather conditions, the expanse of the smoke screen can be substantially larger. When a greater smoke screen effect, a longer effective smoke screen time, is required, a corresponding number of high-angle trajectory weapons firing simulators must be brought together.

Given the exemplary embodiment shown in the drawing and described herein, one proceeds in the following way according to the method of the invention: High-angle trajectory weapons fire simulators as shown in FIGS. 1–4 are positioned in the readiness positions 32 at the respective mid-points of the grid squares 30 indicated with solid circles in FIG. 5. All readiness locations 32, i.e. those not equipped with high-angle trajectory weapons fire simulators as well, are displayed on the computer screen of the high-angle fire referee at the central referee location SZ.

At the start of combat simulation, the sixteen high-angle trajectory weapons fire simulators provided in the exemplary embodiment of FIG. 5 assume their initial readiness locations 32, the readiness locations A1, A9, A10, B2, B10, C1, C2, C3, C9, C10, D1, D9, D10, E1 and E10 being equipped according to FIG. 5. Since the high-angle trajectory weapons fire simulators are equipped with GPS and a data link, the corresponding high-angle fire simulator symbols appear on the screen viewed by the high-angle fire referee in the central referee location SZ and are stored in the computer thereof.

At the deployment presentation wall of the central referee location SZ, the high-angle fire referee can exactly follow the course of combat in the case of an exercise team RED (at the bottom in FIG. 5) and team BLUE (at the top in FIG. 5), so that he is able to estimate potential targets 34 for high-angle fire weapons. For the RED and BLUE teams respectively, these should be the region between FLOT (Front line of team) through approximately 1 kilometer to the rear of FLOT in nearly 100% of the cases, as well as the areas of combat command posts and reserves.

Corresponding to the course of combat, the high-angle trajectory weapons fire referee can thus command the high-angle trajectory weapons fire simulators to those readiness locations 32 that lie favorably for a potential mission. In this way, the high-angle trajectory weapons fire simulators are always located in the proximity of the exercise troops, regardless of whether they are engaged, and they are not an early warning indication for impending high-angle trajectory weapons fire deployment. Since the locations of the high-angle trajectory weapons fire simulators are always displayed to the high-angle fire referee via GPS, the high-angle fire simulators can assume positions in a certain perimeter around the readiness locations 32 that preclude an impediment of the exercising troops.

An example of the change in position of a high-angle trajectory weapons fire simulator in accordance with the inventive method is as follows: The high-angle fire referee issues a command via data link to the high-angle trajectory weapons fire simulator in grid square D1: "high-angle fire simulator . . . immediate change in position to D2". The operator of the high-angle trajectory weapons fire simulator is alerted by an acoustic or visual signal, reads the command from the viewing screen and confirms the reception of the command by pressing a button on the communication unit CU. The commanded high-angle trajectory weapons fire simulator then moves to the readiness location in the mid-point of grid square D2 that was known to the operator of the high-angle trajectory weapons fire simulator either from earlier reconnaissance, or by being located with the GPS. After arrival at readiness location 32 of grid square D2, the high-angle trajectory weapons fire simulator assumes a position that does not represent an obstacle to the exercising troops, and communicates the coordinates of his location to the high-angle fire referee by pressing another button on the communication unit CU.

The employment of the high-angle trajectory weapons fire simulator that was set forth above for simulating fire can be presented in the following way: The high-angle fire referee is coupled into the fire command channels for both the BLUE and RED teams. The high-angle fire referee receives a firing command (listens-in or is connected in the data link). The high-angle fire referee enters coordinate scale, target elevation, type of fire and, potentially, target axis into the computer at the referee location SZ. The computer immediately calculates the most favorable firing location for the appertaining high-angle trajectory weapons fire simulator, whereby all potential firing locations for the high-angle trajectory weapons fire simulator lie on a circular periphery halving a 300 meter radius around the possible target 34. Subsequently, the general specification of the direction from the high-angle trajectory weapons fire simulator to the firing position 36 or 38 to be selected, or to the target 34, ensues, whereupon the selected high-angle trajectory weapons fire simulator is alerted proceeding from the central referee location SZ. The operator then reads the firing command from the viewing screen, the firing position 36 or 38 to be assumed and, finally, the general direction. By pressing a button on the communication unit CU, reception of the firing command is confirmed. The operator drives the vehicle 10 to the commanded firing position 36 or 38, whereby the orientation ensues with the assistance of the GPS carried by the high-angle trajectory weapons fire simulator. The firing position is occupied with a precision of +/–30 m with the recommended, general direction, whereby the terrain should be relatively flat, and no obstacle should be located immediately in front of the firing position, and no exercise troops should be located up to approximately 10 m in front of the firing position. By pressing a button on the communication unit CU, the operator of the high-angle trajectory weapons fire simulator communicates the position coordinates and the elevation of the appertaining high-angle trajectory weapons fire simulator (from GPS) to the high-angle trajectory weapons fire referee, as well as the orientation in space (from the gyroscope). Further, readiness for action is reported, together with a message "security established".

With a computer, the high-angle trajectory weapons fire referee then determines the fire command for the high-angle trajectory weapons fire simulator, composed of bearing information, type of fire (individual, semi-automatic, automatic, battery, battalion, flare fan, etc.), as well as the number of round/groups. This fire command is communicated to the high-angle trajectory weapons fire simulator and automatically brings the firing unit 12 thereof to bear accordingly. "Ready to fire" appears in the viewing window of the operator of the high-angle trajectory weapons fire simulator. The operator communicates "security present" to the high-angle trajectory weapons fire referee by pressing a button on the communication unit CU. The high-angle trajectory weapons fire referee triggers the firing from the central referee location SZ, as recommended from the fire command channel (the designation TOT or the message "fired" or numbering by VB appears on the screen).

The operator of the high-angle trajectory weapons fire simulator has a safety button which can be pressed given a safety hazard in the appertaining firing position 36 or 38 immediately stops the simulation deployment. After the conclusion of the firing order, the high-angle fire referee communicates the instruction "firing pause" as well as instructions for further action (for example, occupying a new readiness location 32) to the operator of the high-angle trajectory weapons fire simulator. During the firing pause or at the readiness location 32 that has been newly occupied, the high-angle trajectory weapons fire simulator can be reloaded.

As already set forth, the simulation ammunition of the main firing platform 16 has a standard firing range of 300 m. As a result favorable travel distances from the individual readiness locations 32 to the possible firing positions 38 or 38, a low scatter of the simulation ammunition, a reliable detonation height of the simulation ammunition without the necessity of extremely expensive double or wide angle squibs as well as an elimination of the necessity of an elevation directivity of the firing means 12 are achieved.

The following is to be assumed regarding the expedient number of high-angle trajectory weapons fire simulators to be used for a given exercise. A reinforced motorized infantry battalion seldom assumes a front deployment larger than 5 km. The targets for Art/Mrs fire lie mainly in a region from the FLOT to approximately 1000 m to the rear of the FLOT, excepting command posts and reserve quarters. Accordingly, eight high-angle fire simulators respectively utilized for each of the RED and BLUE teams should be adequate, this forming the basis of the illustration of FIG. 5.

The "hit" indication (personnel and material) in the target 34 can be realized with suitable sensors. Such sensors can sense the detonation simulation ammunition up to, for example, a maximum range of 50 m and process these signals as in AGDUS. The outcome that occurs given Art/Mrs deployment when the target only lies in the shrapnel range of the ammunition can thus also be simulated.

The inventively employed simulation ammunition satisfies the safety demands of simulation or exercise ammunition that are already known. An invariable firing angle can be defined in the high-angle trajectory weapons fire simulator, which guarantees an absolutely reliable trajectory height will already be reached only a few meters in front of the high-angle trajectory weapons fire simulator, and thus the invariable trajectories allow a reliable detonation height of the simulation ammunition in the target. By simply pressing a button, the operator of the high-angle trajectory weapons fire simulator can, as already set forth, immediately terminate every firing order when the safety in the firing position 36 or 38 is no longer assured.

The "signature" characteristics of all significant types of artillery and mortar fire can be implemented in a realistic way given the method of the invention, i.e. spatial expanse and number of rounds in real time corresponding to real deployment, but the firing system is miniaturized to the greatest possible extent. Types of fire, for example battalion mass fire, for which eighteen pieces are required in real deployment, can be executed with a single high-angle trajectory weapons fire simulator of the invention and can be multiply repeated without reloading. By contrast to real artillery pieces or mortars wherein the required firing range is achieved by different propulsive charges and barrel elevations, the firing range that can be achieved given the high-angle trajectory weapons fire simulator is defined by the location of the firing position 36 or 38. In real deployment, the spatial target coverage is achieved by the system-conditioned scatter or by different lateral and elevational direction of the individual artillery pieces, or mortars given larger targets. The high-angle trajectory weapons fire simulator of the invention achieves this type of target coverage on the basis of different but usually stationary lateral and elevational directions of the individual firing barrels provided for that purpose.

Far more than one hundred persons are required in an artillery battalion for conducting a mass fire. The method of the invention only requires two persons for this purpose, namely the high-angle fire referee in the central referee location SZ and the operator or driver of the high-angle trajectory weapons fire simulator, insofar as automatic high-angle fire simulator guidance is not provided.

A further advantage is that a week-long training is required in order to make a gun crew ready for action; the operator of the high-angle trajectory weapons fire simulator of the invention by contrast, only requires a brief instruction. This can be any desired truck driver whose specific job, in addition to driving, is essentially that of paying attention as to whether safety is established in front of the firing barrels. If this is not the case, he merely has to press a button, for example, "mission abort".

Whereas real pieces require a safety zone that is several hundred meters large in front of the barrels, the barrel elevation of the high-angle trajectory weapons fire simulator of the invention is preferably defined such that no hazard for personnel and apparatus can occur beginning with a distance of ten meters therefrom.

Finally, it should also be noted that the type and propulsive charge for every round of ammunition must be defined and loaded at every piece in real deployment, whereas this problem is avoided by automatic, electronic selection of the respectively correct firing barrel given the high-angle trajectory weapons fire simulator of the invention as a consequence of the large number of barrels having "standard charge" that are available.

Of course, one can also proceed in the method of the invention, given an appropriate design of the high-angle trajectory weapons fire simulators such that the each high-angle fire simulator moves automatically and also fires simulation ammunition automatically dependent on commands provided from the central referee location SZ.

Although modification and changes may be suggested by those skilled in the art, it is the intention of the inventor to embody within the patent warranted hereon all changes and modifications as reasonably and properly come within the scope of his contribution to the art.

I claim as my invention:

1. A method for simulating high-angle combat conditions weapons fire to persons in a selected target zone surrounding a target region, for use with a plurality of combat vehicle-mounted high-angle trajectory weapons fire simulators, comprising the steps of:

dividing a combat exercise field into a plurality of grid squares each having a mid-point;

selecting a size of said grid squares so that, starting from the mid-point of any grid square, a neighboring grid square can be reached in less than a minute by a combat vehicle-mounted high-angle trajectory weapons fire simulator;

positioning respective combat vehicle-mounted high-angle trajectory weapons fire simulators at readiness positions at the respective mid-points of a selected number of said grid squares which is less than said plurality of grid squares;

establishing a communication path between each combat vehicle-mounted high-angle trajectory weapons fire simulator and a central referee location;

providing an identification of the position of each combat vehicle-mounted high-angle trajectory weapons fire simulator to said central referee location;

equipping each combat vehicle-mounted high-angle trajectory weapons fire simulator with means for firing simulation ammunition at a high-angle trajectory;

identifying, at said central referee location, a target region on said combat exercise field, said target region being reachable by simulated fire from at least one firing position on said combat exercise field;

selecting, at said central referee location, one of said combat vehicle-mounted high-angle trajectory weapons fire simulators at a readiness position most favorably located to reach a firing position relative to said target region;

commanding said one of said combat vehicle-mounted high-angle trajectory weapons fire simulators to said firing position from its readiness position from said central referee position via said communication path; and simulating high-angle trajectory weapons fire by commanding said one of said combat vehicle-mounted high-angle trajectory weapons fire simulators to fire said simulated ammunition at said high-angle trajectory at said target region after said one of said combat mounted high-angle weapons fire simulators reaches said firing position.

2. A method as claimed in claim 1 wherein the step of equipping each combat vehicle-mounted high-angle weapons fire simulator with means for selectively firing simulation ammunition comprises equipping each combat vehicle-mounted high-angle trajectory weapons fire simulator with means for selectively firing different types of simulated ammunition at a high-angle trajectory for respectively simulating different types of weapons fire, and said method comprising the additional step of:

selecting, at said central referee location, one of said types of simulated ammunition be fired and conveying the selected one of said types to said one of said combat vehicle-mounted high-angle trajectory weapons fire simulator via said communication path prior to commanding firing of said simulation ammunition.

3. A method as claimed in claim 1 wherein the step of selecting a size of said grid squares comprises selecting a size of said grid squares so that each grid square has an edge length of approximately one kilometer.

4. A method as claimed in claim 3 wherein the step of a continually providing an identification of the position of each combat vehicle-mounted high-angle trajectory weapons fire simulator to said central referee location comprises providing an identification of the position of each combat vehicle-mounted high-angle trajectory weapons fire simulator to said central referee location using a global positioning system.

5. A method as claimed in claim 1 wherein the step of providing an identification of the position of each combat vehicle-mounted high-angle trajectory weapons fire simulator to said central referee location comprises continuously and automatically providing an identification of the position of each combat vehicle-mounted high-angle weapons fire simulator to said central referee location.

6. A method as claimed in claim 5 wherein the step of continually providing an identification of the position of each combat vehicle-mounted high-angle trajectory weapons fire simulator to said central referee location comprises the steps of:

equipping each combat vehicle-mounted high-angle trajectory weapons fire simulator with position-identifier means for gyroscopically identifying a position of that combat vehicle-mounted high-angle trajectory weapons fire simulator and for generating a signal identifying said position; and supplying said signal from said position-identifier means via said communication path to said central referee location.

7. A method as claimed in claim 1 comprising the additional steps of:

equipping each combat vehicle-mounted high-angle trajectory weapons fire simulator with a plurality of magazine plates, each magazine plate containing a different type of simulation ammunition for respectively simulating different types of weapons fire;

equipping each combat vehicle-mounted high-angle trajectory weapons fire simulator with means for selectively and individually horizontally and vertically adjusting a firing direction for each of said magazine plates; and selecting, at said central referee location, one of said magazine plates to be fired and selecting a firing direction for said one of said magazine plates; and command, via said communication path from said central referee location, said one of said combat vehicle-mounted high-angle trajectory weapons fire simulator to fire the selected magazine plate at the selected direction at said target region.

8. An apparatus for simulating high-angle trajectory weapons fire comprising:

a mobile combat vehicle;

simulation ammunition shells carried by said vehicle;

means mounted on said vehicle for firing multiple rounds of said simulation ammunition shells in a firing direction and means for adjusting said firing direction around a horizontal axis; and communication means carried by said vehicle for placing said firing means in communication with a remote location for receiving signals from said remote location for adjusting said firing direction.

9. An apparatus as claimed in claim 8 wherein said simulation ammunition shells comprise items selected from the group consisting of HE/bomlets, flares, mine simulation ammunition, mortar simulation ammunition and artillery simulation ammunition.

10. An apparatus as claimed in claim 8 wherein said simulation ammunition shells comprise a plurality of different types of simulation ammunition shells for respectively simulating different types of weapons fire, and wherein said firing means comprises a plurality of magazine plates, each magazine plate containing exclusively one of said types of simulation ammunition shells, and each magazine plate having a plurality of firing barrels for said simulation ammunition shells.

11. An apparatus as claimed in claim 10 wherein each of said different types of said simulation ammunition shells has a caliber of 26 mm.

12. An apparatus as claimed in claim 10 wherein said firing means comprises three of said magazine plates having a total of 164 firing barrels.

13. An apparatus as claimed in claim 10 wherein each of said magazine plates has a different color.

14. An apparatus as claimed in claim 10 wherein said firing means comprises a main firing platform and means for sliding said magazine plates onto said main firing platform.

15. An apparatus as claimed in claim 10 wherein said firing means comprises a main firing platform and means for mounting said magazine plates on said main firing platform with respectively diverging firing directions.

16. An apparatus as claimed in claim 15 further comprising means for individually selecting the firing direction of each magazine plate.

17. An apparatus as claimed in claim 16 wherein said communication means comprises means for permitting selection of the firing direction for each magazine plate from said remote location.

18. An apparatus as claimed in claim 8 further comprising subsidiary simulation ammunition shells, and wherein said firing means comprises a main firing platform for firing said simulation ammunition shells and a subsidiary firing platform for firing said subsidiary simulation ammunition shells.

19. An apparatus as claimed in claim 18 wherein said firing means comprises a horizontally disposed turntable mounted on said vehicle with said main firing platform and said subsidiary firing platform being mounted on said turn table with respective firing direction offset by 180°, with each of said name firing platform and said subsidiary firing platform being oriented for firing radially obliquely upwardly and outwardly from said turn table.

20. An apparatus as claimed in claim 18 wherein said subsidiary simulation ammunition shells comprise shells selected from the group consisting of shells for smoke screen and ABC ammunition.

21. An apparatus as claimed in claim 18 wherein said subsidiary simulation ammunition shells comprise shells having a caliber of 81 mm.

22. An apparatus as claimed in claim 8 further comprising means for automatically and continuously reporting a position of said vehicle to said remote location.

23. An apparatus as claimed in claim 22 wherein said means for reporting comprises a global positioning system.

24. An apparatus as claimed in claim 22 wherein said means for reporting comprises a gyroscopic location identification system.

25. An apparatus as claimed in claim 8 further comprising means for controlling a position of said vehicle from said remote location.

26. An apparatus as claimed in claim 8 wherein said simulation ammunition shells comprise a plurality of different types of simulation ammunition shells for respectively simulating different types of weapons fired, and wherein said apparatus further comprises means for selecting one of said types of simulation ammunition shells at said remote location and for conveying the selected type of simulation ammunition shells to said vehicle via said communication means.

27. An apparatus as claimed in claim 8 wherein said vehicle comprises means for seating a human in said vehicle and means for manually operating said vehicle by a human seated therein.

28. An apparatus as claimed in claim 8 wherein said simulation ammunition shells each comprise a squib, a propulsive charge for a firing range, an active charge and a delay element.

29. An apparatus as claimed in claim 28 wherein said propulsive charge has a firing range of approximately 300 m.

30. An apparatus as claimed in claim 28 wherein said simulation ammunition shells comprise a plurality of groups of simulation ammunition shells with the shells in the respective groups of simulation ammunition shells having different propulsive charges for respectively different firing ranges.

31. An apparatus as claimed in claim 28 wherein said simulation ammunition shells comprise a plurality of groups of simulation ammunition shells with the shells in the respective groups of simulation ammunition shells having different active charges for respectively simulating different types of weapons fire.

32. An apparatus as claimed in claim 28 wherein said simulation ammunition shells comprise a plurality of groups of simulation ammunition shells with the shells in the respective groups of simulation ammunition shells having respectively different delay elements for delaying detonation of said active charge by respectively different times.

* * * * *